US009387668B2

(12) United States Patent
Oron et al.

(10) Patent No.: US 9,387,668 B2
(45) Date of Patent: Jul. 12, 2016

(54) PRINTING SYSTEM AND PRINTING METHOD

(71) Applicant: Hewlett-Packard Indigo, B.V., Amstelveen (NL)

(72) Inventors: Gadi Oron, Ness Ziona (IL); Doron Schlumm, Ness Ziona (IL); Gil Fisher, Ness Ziona (IL)

(73) Assignee: Hewlett-Packard Indigo B.V., Maastricht (NL)

( * ) Notice: Subject to any disclaimer, the term of this patent is extended or adjusted under 35 U.S.C. 154(b) by 0 days.

(21) Appl. No.: 14/646,662

(22) PCT Filed: Nov. 29, 2012

(86) PCT No.: PCT/EP2012/073941
§ 371 (c)(1),
(2) Date: May 21, 2015

(87) PCT Pub. No.: WO2014/082668
PCT Pub. Date: Jun. 5, 2014

(65) Prior Publication Data

US 2015/0306869 A1 Oct. 29, 2015

(51) Int. Cl.

| | |
|---|---|
| ***B41J 29/38*** | (2006.01) |
| ***B41J 2/06*** | (2006.01) |
| ***B41J 2/085*** | (2006.01) |
| ***B41J 2/09*** | (2006.01) |
| ***B41J 2/035*** | (2006.01) |
| ***G03G 15/10*** | (2006.01) |

(52) U.S. Cl.
CPC ..... *B41J 2/035* (2013.01); *G03G 15/105* (2013.01)

(58) Field of Classification Search
CPC ..... B41J 2/105; B41J 11/007; B41J 2/09; B41J 2/035; B41J 2002/043; B41J 2002/062; B41J 2/41; B41J 29/38
USPC ..... 347/6, 55, 76, 77
See application file for complete search history.

(56) References Cited

U.S. PATENT DOCUMENTS 5,801,734 A * 9/1998 Schneider ..... B41J 2/085 347/76
6,270,204 B1 8/2001 Barrett et al.
6,350,009 B1 2/2002 Freund et al.

(Continued)

FOREIGN PATENT DOCUMENTS

EP 0780230 A2 6/1997

OTHER PUBLICATIONS

International Search Report and Written Opinion dated Aug. 2, 2013 issued on PCT Patent Application No. PCT/EP2012/073941 dated Nov. 29, 2012, European Patent Office.

(Continued)

*Primary Examiner* — Jannelle M Lebron
(74) *Attorney, Agent, or Firm* — HP Inc Patent Department

(57) ABSTRACT

According to one example, there is provided a printing system. The printing system comprises a printhead receiver to receive a printhead, the printhead to eject printing fluid drops from an array of printhead nozzles to a first printing fluid receiving zone. The printing system further comprises an electrostatic imaging member to store a latent image comprising charged and non-charged portions representing an image to be printed. Part of the electrostatic imaging member is arranged in close proximity to the array of nozzles such that ejected printing fluid drops are electrostatically deflected by charged portions of the electrostatic imaging member to a second printing fluid receiving zone.

19 Claims, 5 Drawing Sheets

(56) References Cited

U.S. PATENT DOCUMENTS

| | | | |
|---|---|---|---|
| 6,481,835 | B2 | 11/2002 | Hawkins et al. |
| 8,104,879 | B2 | 1/2012 | Barbet |
| 2006/0001722 | A1 | 1/2006 | Stelter et al. |
| 2012/0182362 | A1 | 7/2012 | Odin |

OTHER PUBLICATIONS

Seija Ristimaki, "Digital Printing Techniques", EDMM European Digital Media Management; Intensive Programme, Budapest Aug. 19-Sep. 8, 2007, pp. 75.

* cited by examiner

PRINTING SYSTEM AND PRINTING METHOD

CLAIM FOR PRIORITY

The present application is a national stage filing under 35 U.S.C 371 of PCT application number PCT/EP2012/073941, having an international filing date of Nov. 29, 2012, the disclosure of which is hereby incorporated by reference in its entirety.

BACKGROUND

Continuous ink jet printing uses printheads that eject a continuous stream of individual ink drops. Some continuous inkjet printing systems use high-voltage electrodes in close proximity to the ejected ink drops to selectively deflect ink drops to electrostatically control which of the ink drops reach a print zone. In this way a desired image may be formed on a media in the print zone.

However, it is generally difficult to make small electrodes and this limits the resolution of continuous printing systems. Furthermore, controlling the electrodes requires complex and expensive hardware.

BRIEF DESCRIPTION

Examples, or embodiments, of the invention will now be described, by way of non-limiting example only, with reference to the accompanying drawings, in which.

DETAILED DESCRIPTION

Figure 1:
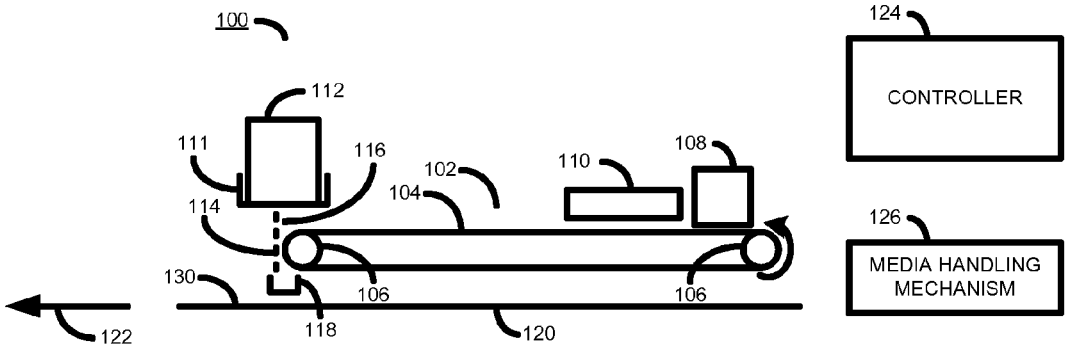
FIG. 1 is a simplified side view of a printing system according to one example.
Figure 2:
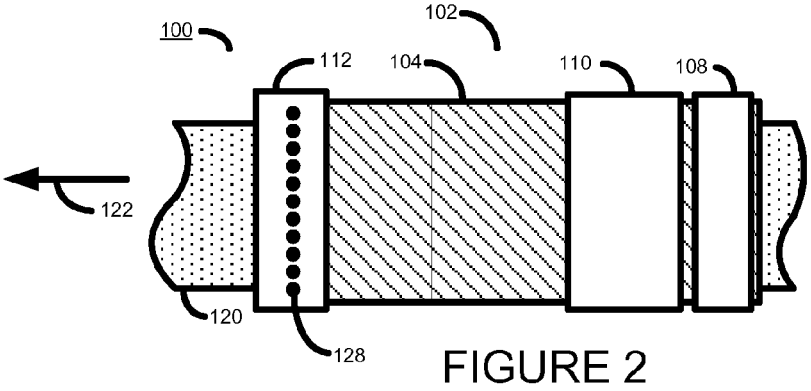
FIG. 2 is a simplified plan view of a printing system according to one example.

Referring now to FIG. 1 there shown a simplified side view of a printing system 100 according to one example. A corresponding plan view is shown in FIG. 2.

The printing system 100 comprises an electrostatic imaging member 102 (generally shown as 102 in FIG. 1) on which a latent electrostatic image is generated. The latent image comprises electrostatically charged and non-charged portions that represent an image to be printed.

In one example the printing system 100 is a single colour printing system, in which case the term 'latent image' represents the single colour image to be printed.

As described further below, in a further example the printing system 100 is part of a colour printing system. In this case the term 'latent image' represents a single colour separation of an image to be printed.

In one example the electrostatic imaging member 102 is a photoconductor member 102. In other example other kinds of electrostatic imaging member may be used.

In this example the photoconductor member 102 comprises a continuous photoconductor belt 104 that rotates about a pair of rollers 106. One or both of the rollers 106 may be powered to cause the photoconductor belt to rotate or revolve in a known manner. In another example the photoconductor belt may be a photoconductor roller, cylinder, drum, or the like. The photoconductor member 102 has a surface that is able to hold an electrostatic charge and in which portions of the electrostatic charge may be dissipated in a controlled manner by shining light onto a portion of the photoconductor surface.

In one example the photoconductor member 102 may be a photoconductor member such as an organic photoconductor comprising a suitable doped organic material. Such photoconductors are widely used in known printing systems. For example, such photoconductors are commonly used in liquid electro-photographic printing systems, such as in Hewlett-Packard Indigo digital printing presses.

As the photoconductor belt 104 rotates, a charging module 108 applies a substantially uniform electrostatic charge on a portion or the whole of the photoconductor belt 104. In one example the charging module 108 is a charging roller, although in other example other types of charge inducing mechanism may be used, for example such as a corona discharge module.

In one example the charging module 108 may apply a substantially uniform charge in the region of about +/−1000 V, although in other examples higher or lower levels of charge may be applied. In some examples a positive charge may be applied to the photoconductor belt 104, although in other examples a negative charge may be applied to the photoconductor belt 104.

An imaging module 110 selectively dissipates electrical charges on the photoconductor belt 104 based on an image. For example, the imaging module 110 may comprise a laser or light emitting diode (LED) imaging module that selectively shines light on the photoconductor belt 104 corresponding to an image to be printed to selectively dissipate electrical charges on the photoconductor belt 104. This leaves a latent image comprising charged and non-charged portions of the photoconductor belt 104 that represent the image to be printed.

The printing system 100 further comprises a printhead receiver 111 for receiving a printhead 112 having an array of printhead nozzles 128 (shown in FIG. 2) through each of which a stream of individual printing fluid drops may be ejected. The printhead receiver 111 may be any suitable mechanical and/or electrical interface into which a printhead 112 may be inserted. During operation, the printhead 112 may eject a continuous stream of printing fluid drops.

The printing fluid may be any suitable printing fluid, such as an ink, or a post or pre-treatment printing fluid such as a primer or varnish.

Printing fluid may be supplied to the print head 112 by a printing fluid supply system (not shown). The printing fluid supply system may be integral or external to the printhead 112. In the examples described herein each printhead is supplied with a single type or colour of printing fluid, such as a single colour of printing ink.

Hereinafter use of the term ink should, unless the context suggests otherwise, be understood to cover any suitable printing fluid including both ink and non-ink printing fluids.

The stream of ink drops ejected from each printhead nozzle 128 comprises a continuous stream of individual ink drops. The printhead 112 ejects drops having a substantially constant velocity, a substantially constant volume, and a substantially constant drop rate. In one example, the continuous inkjet printhead 112 may eject drops at the rate of between about 50,000 to 200,000 drops per second. In one example each drop may have a volume in the range of about 2 to 200 Pico liters. In one example each ejected drop may have a speed in the range of about 2 to 40 m/s.

The nozzles 128 are arranged to span across substantially the whole width of the photoconductor belt 104 and may be disposed in a single or in multiple printheads. The nozzles 128 may be arranged in a one-dimensional array. Ink drops ejected from each nozzle follow a path 114 downwards towards a first ink receiving zone 118. In the present example the first ink receiving zone is an ink collection zone in the form of an ink collector 118. In one example the path 114 is a vertical or substantially vertical path. In other examples the path 114 may be an inclined path. Ink drops diverted to the ink collector 118 may be recycled and reused by the printhead 112.

One portion, in this example an end portion, of the photoconductor belt 104 is arranged in proximity to the continuous ink jet printhead 112 such that the photoconductor belt 104 is in close proximity to the ink drop path 114. The zone in closest proximity to the ink drop path and the photoconductor belt 104 is referred to herein as an ink drop deflection zone 116.

In one example the printing fluid may be electrically charged by a printing fluid charging module (not shown). The charging is suitable performed before the printing fluid arrives in the printing fluid or ink deflection zone 116 and may, for example, be suitably performed before or after the ink or printing fluid is ejected from the printhead.

Figure 3:
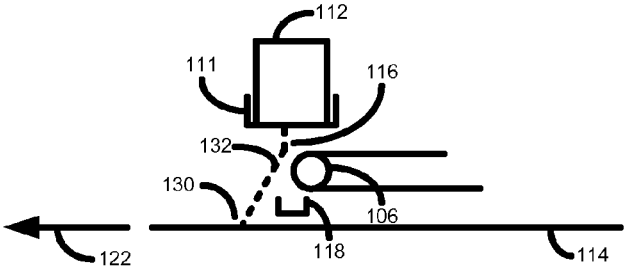
FIG. 3 is a simplified side view of a portion of a printing system according to one example.

As the photoconductor belt 104 with a latent image thereon rotates, ejected ink drops are electrostatically deflected by charged portions of the photoconductor in the ink drop deflection zone 116 such that the deflected ink drops follow a second ink drop path 132 (FIG. 3) to a second ink receiving zone 130. In the present example the second ink receiving zone 130 is a print zone 130. Thereby, ink drops deflected to the print zone 130 may create ink marks on a media 120 positioned in the print zone 130 to form a printed image as the media 120 is advanced through the print zone 130 by a media handling mechanism 126.

The distance between the photoconductor belt 104 and the ink drop path 114 may be chosen based in part on the voltage of the electrical charge on the photoconductor belt 104.

In one example, where the voltage of the electric charge applied to the photoconductor belt 104 is about 1000 V, the photoconductor belt 104 may be positioned at a distance of about 100 microns from the stream of ejected ink drops 114. In other examples other distances may be chosen.

Figure 4:
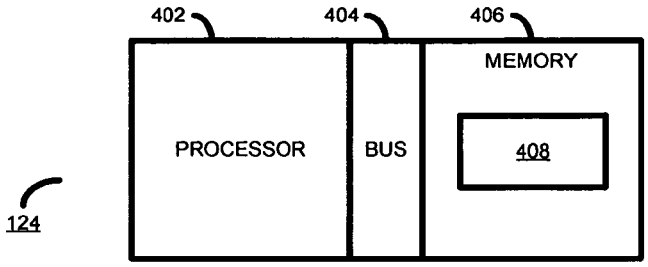
FIG. 4 is a simplified block diagram of a printer controller according to one example.
Figure 5:
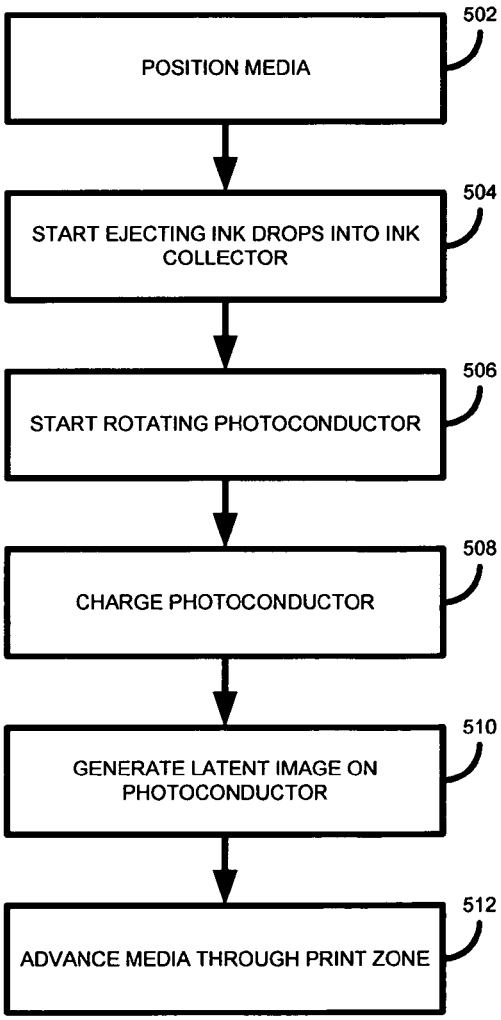
FIG. 5 is a flow diagram outlining a method of operating a printing system according to one example.

The printing system 100 is generally controlled by a printer controller 124. As shown in FIG. 4, the controller 124 comprises a processor 402 such as a microprocessor, a microcontroller, a computer processor, or the like. The processor 402 is in communication with a memory 406 via a communication bus 404. The memory 406 stores computer implemented instructions 408 that, when executed by the processor 402 cause the controller 124 to operate the printing system 100 in accordance with the method described below and as illustrated in FIG. 5.

At block 502 the controller 124 controls the printing system 100, and in particular the media handling system 126, to position a sheet or web of media in the print zone 130.

At block 504 the controller 124 controls the printhead 112 to start ejecting a stream of individual ink drops. The controller controls the printhead 112 to eject a stream of ink drops of a substantially constant volume, at a substantially constant speed, and at a substantially constant rate. The ejected ink drops are ejected into the ink collector 118.

At block 506 the controller 124 controls the photoconductor belt 104 to start rotating. The linear speed at which the controller 124 controls the photoconductor belt 124 to rotate at may be derived, at least in part, from the speed of the ejected ink drops and the separation between consecutive ejected drops.

At block 508 the controller 124 controls the charging module 108 to apply a uniform electrostatic charge along a portion of the photoconductor belt 104 in proximity to the charging module 108.

At block 510 the controller 124 controls the imaging module 110 to selectively dissipate electrical charges on the photoconductor belt 104, in accordance with an image to be printed, to generate a latent image on the photoconductor belt 104.

At block 512 the controller 124 controls the media handling mechanism 126 to advance the media 130 through the print zone 130 in synchronization with the latent image on the photoconductor belt 104. This may include, for example, starting to advance the media through the print zone 130 when the leading edge of the latent image on the photoconductor belt 104 arrives at a predetermined position in the ink drop deflection zone 116. The controller 124 controls the media handling mechanism 126 to advance the media 120 through the print zone 130 at the same linear speed at which the photoconductor belt is rotated.

As the photoconductor belt 104 is rotated electrostatic charges on the photoconductor belt 104 in the region of the ink drop deflection zone cause ejected ink drops in proximity to those electrostatic charges to be deflected out of the path 114 and into path 132, such that the ejected drops are ejected to the print zone 130.

In this way an image corresponding to the latent image created on the photoconductor belt 104 is printed on the media 120 by ink drops ejected by the printhead 112.

One advantage of using a latent electrostatic image on a photoconductor member to control the ejection paths of ink drops ejected from a continuous inkjet printhead is that the technology used to produce such latent images is tried and tested technology. For example, Hewlett-Packard's range of Indigo presses use such technology in their liquid electrophotographic (LEP) printing systems. A further advantage is that the examples described herein provide a simple way of controlling ink drops ejected from a wide array of printhead nozzles, thereby enabling continuous ink jet printing to be performed on wide media sizes, and with a high printing resolution.

Furthermore, in the examples described above herein no physical contact is made with the outer surface of the photoconductor member, which helps to prolong the life of the photoconductor member.

Figure 6:
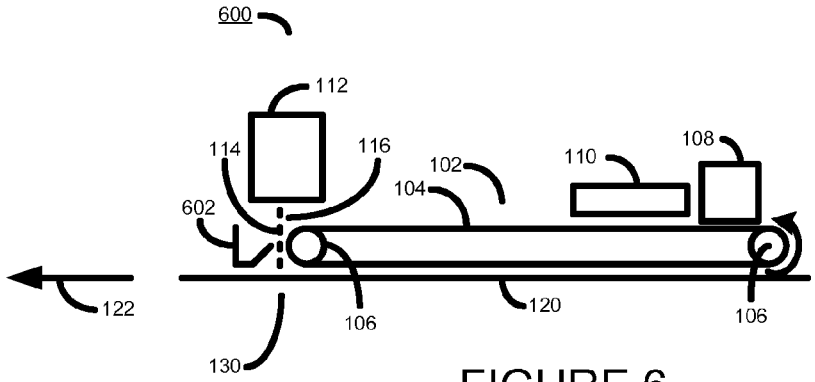
FIG. 6 is a simplified side view of a printing system according to one example.

Referring now to FIG. 6 there is a shown a printing system 600 according to a further example. In this example the printhead 112 is arranged to eject ink drops in the print zone 130.

Figure 7:
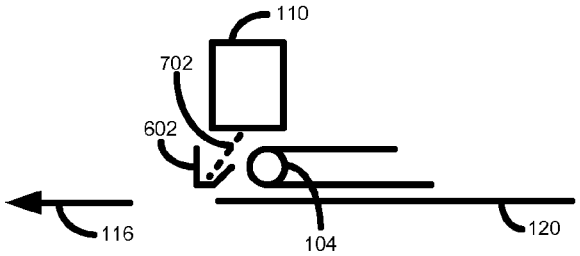
FIG. 7 is a simplified side view of a portion of a printing system according to one example.

An ink collector 602 is provided in close proximity to the path 114 of ejected ink drops such that electrostatic charges on the photoconductor belt 104 in the region of the ink deflection zone 116 cause the electrostatic deflection of ink drops to a path 702 and into the ink collector 602, as illustrated in FIG. 7. In this example deflected ink drops do not reach the print zone 130

Figure 8:
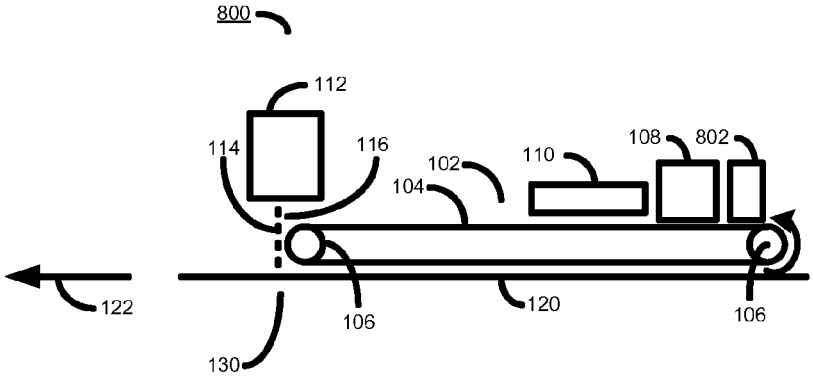
FIG. 8 is a simplified side view of a printing system according to one example.
Figure 9:
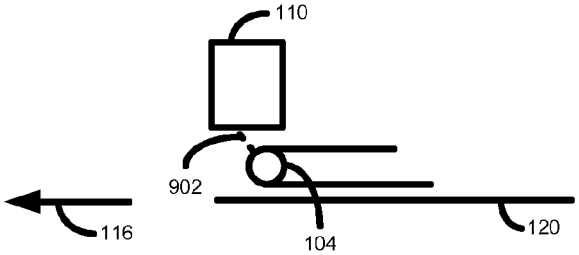
FIG. 9 is a simplified side view of a portion of a printing system according to one example.

Referring now to FIG. 8 there is shown a printing system 800 according to a yet further example. In this example the printhead 112 is arranged to eject ink drops in the print zone 130. Electrostatic charges on the photoconductor belt 104 in the region of the ink deflection zone 116 cause the electrostatic deflection of ink drops to a path 902 and onto the photoconductor belt 104, as illustrated in FIG. 9. In this way, ink drops which are not intended to be printed on a media are ejected on to the photoconductor belt 104. To remove this unwanted ink a photoconductor cleaning module 802 is provided to remove any ink on the photoconductor prior to a new latent image being generated thereon.

Figure 10:
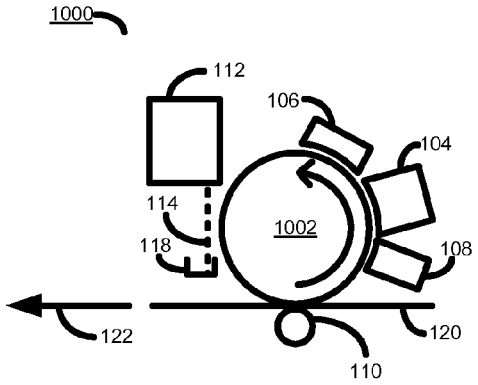
FIG. 10 is a simplified side view of a printing system according to one example.
Figure 11:
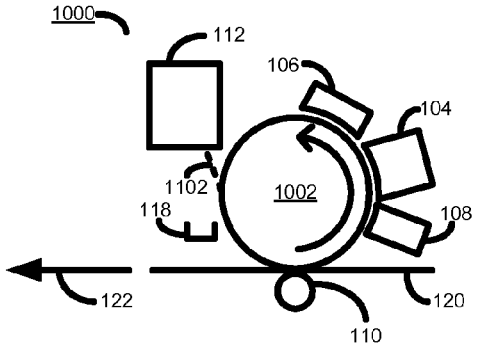
FIG. 11 is a simplified side view of a printing system according to one example.
Figure 12:
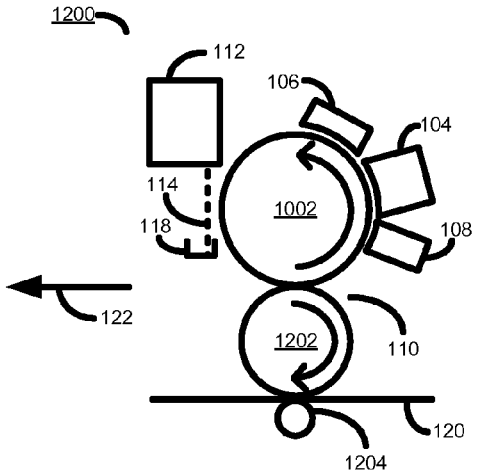
FIG. 12 is a simplified side view of a printing system according to one example.

Referring now to FIG. 10 there is shown a printing system 1000 according to a further example. In this example the photoconductor member is provided in the form of a photoconductor drum 1002, for example with a photoconductor foil or layer attached to the outside of a drum. In this example the printhead 112 is arranged to eject ink drops into an ink collector 118. A latent image of electrostatic charges is generated on the photoconductor drum 1002 in the manner described above. Electrostatic charges on the photoconductor drum 1002 in proximity to an ink drop deflection zone cause ink drops to be diverted into an ink receiving zone that forms a print zone on the surface of photoconductor drum 1002, as illustrated in FIG. 11 to cause an image to be printed on the surface of the photoconductor drum 1002 as the photoconductor drum 1002 rotates. Ink drops of the photoconductor drum 1002 may then be transferred to a sheet or web of media 120 by feeding the media through a nip formed between the photoconductor drum 1002 and a transfer roller 110. The transfer of the image onto the media takes place through to the application of pressure between the media and the photoconductor drum 1002.

It a yet further example, a printing system 1200 is provided. In this example the printing system 1000 of FIG. 11 has an intermediate transfer member (ITM) 1202 onto which the image printed on the photoconductor drum 1002 is transferred. The transferred image on the ITM 1202 is then transferred to a media by feeding the media through a nip formed between the ITM 1202 and a transfer roller 1204. The transfer of the image onto the media takes place through the application of pressure between the media and the photoconductor drum 1002.

Figure 13:
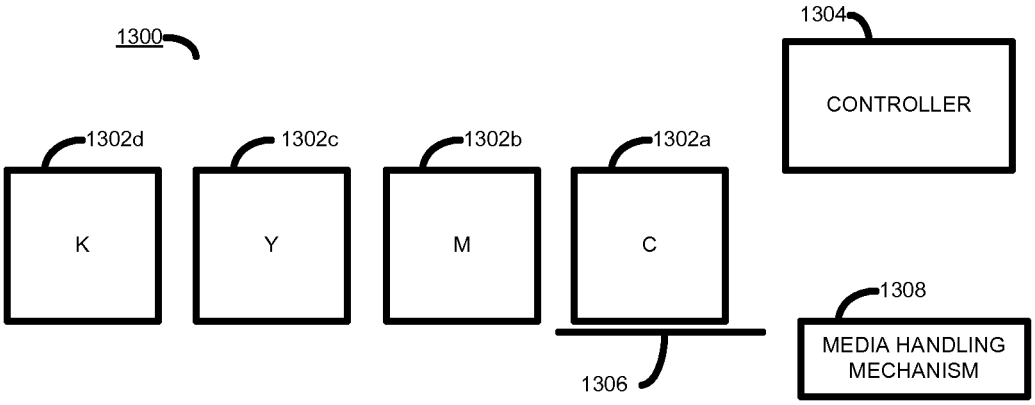
FIG. 13 is a schematic view of a printing system according to one example.

As previously mentioned, the examples described above describe a printing system that prints with a single colour ink. An example colour printing system 1300 is shown in FIG. 13.

The printing system 1300 comprises multiple printing stations 1302. Each printing station 1302 may be a printing system in accordance with one of the example printing systems described above. Each of the printing systems prints with a different colour ink. For example, printing station 1302*a* may print with a cyan coloured ink, printing station 1302*b* may print with a magenta coloured ink, printing station 1302*c* may print with a yellow coloured ink, and printing station 1302*d* may print with a black coloured ink. In other examples more or less printing stations 1302 may be provided.

The printing system 1300 is generally controlled by a controller 1304. The controller 1304 obtains an image to be printed and obtains, or generates, four separate images each representing a different colour separation corresponding to each of the four coloured printing stations 1302. The controller then controls each of the printing stations 1302 in the manner generally described above. The controller 1304 controls a media handling mechanism 1308 to advance a media 1306 through each printing station 1302 such that each of the different images representing different ones of the colour separations are printed on the media 1306, such that a full colour image is printed on the media 1306. The controller 1304 controls each of the printing stations 1302 and the media handling mechanism 1308 such that each of the colour separations is printed with a high degree of image separation registration accuracy.

It will be appreciated that examples and embodiments of the present invention can be realized in the form of hardware, software or a combination of hardware and software. As described above, any such software may be stored in the form of volatile or non-volatile storage such as, for example, a storage device like a ROM, whether erasable or rewritable or not, or in the form of memory such as, for example, RAM, memory chips, device or integrated circuits or on an optically or magnetically readable medium such as, for example, a CD, DVD, magnetic disk or magnetic tape. It will be appreciated that the storage devices and storage media are examples of machine-readable storage that are suitable for storing a program or programs that, when executed, implement examples of the present invention. Examples of the present invention may be conveyed electronically via any medium such as a communication signal carried over a wired or wireless connection and examples suitably encompass the same.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings), may be replaced by alternative features serving the same, equivalent or similar purpose, unless expressly stated otherwise. Thus, unless expressly stated otherwise, each feature disclosed is one example only of a generic series of equivalent or similar features.

The invention claimed is:

1. A printing system, comprising:

a printhead receiver to receive a printhead, the printhead to eject printing fluid drops from an array of printhead nozzles to a first printing fluid receiving zone;

an electrostatic imaging member to store a latent image comprising charged and non-charged portions representing an image to be printed; and wherein part of the electrostatic imaging member is arranged in close proximity to the array of nozzles such that ejected printing fluid drops are electrostatically deflected by charged portions of the electrostatic imaging member to a second printing fluid receiving zone, wherein the electrostatic imaging member is positioned such that a portion thereof forms a printing fluid drop deflection zone in close proximity to the path of ejected printing fluid drops, and wherein the electrostatic imaging member is rotatable such that charged portions of the electrostatic imaging member rotate through the printing fluid drop deflection zone and electrostatically deflect printing fluid drops from the first printing fluid receiving zone to the second printing fluid receiving zone.

2. The printing system of claim 1, wherein the electrostatic imaging member is a photoconductor.

3. The printing system of claim 1, wherein the first printing fluid receiving zone is as printing fluid collection zone, and wherein the second printing fluid receiving zone is a print zone.

4. The printing system of claim 1, wherein the electrostatic imaging member is rotatable to have formed thereon the latent image.

5. The printing system of claim 4, further comprising a media handling mechanism for advancing a sheet or web of media through the print zone, the media handling mechanism to advance the media through the print zone at the same linear speed at which the electrostatic imaging member is rotated.

6. The printing system of claim 1, wherein the first printing fluid receiving zone is a print zone, and wherein the second printing fluid receiving zone is a printing fluid collection zone.

7. The printing system of claim 6, wherein the print zone is a print zone on the surface of a photoconductor drum.

8. The printing system of claim 7, further comprising a transfer roller forming a nip between the photoconductor drum, and wherein printing fluid received on the photoconductor drum is transferred to a media by feeding a media through the nip formed.

9. The printing system of claim 7, further comprising an intermediate transfer member in contact with the photoconductor drum such that printing fluid received on the photoconductor drum is transferred to the intermediate transfer member, the system further comprising a transfer roller forming a nip between the intermediate transfer member, and wherein printing fluid transferred to the intermediate transfer member is transferred to a media by feeding a media through the nip formed.

10. The printing system of claim 1, further comprising a printing fluid charging module to apply an electrical charge to the printing fluid before the fluid arrives at the printing fluid drop deflection zone.

11. A method of printing, comprising:

ejecting printing fluid drops from a continuous inkjet printhead to a first printing fluid receiving zone;

generating an electrostatic latent image on an electrostatic imaging member;

rotating the electrostatic imaging member in close proximity to the printing fluid drops ejected from the printhead such that charged portions of the electrostatic imaging member electrostatically deflect ejected printing fluid drops to a second printing fluid receiving zone.

12. The method of claim 11, wherein the first printing fluid receiving zone is an ink collection zone, and wherein the second printing fluid receiving zone is a print zone, the method further comprising, advancing a media through the print zone such that an image corresponding to the latent image is formed on the media.

13. The method of claim 11, wherein the first printing fluid receiving zone is a print zone on the surface of the electrostatic imaging member, and wherein the second printing fluid receiving zone is an ink collection zone, the method further comprising rotating the electrostatic imaging member to form a printed image corresponding to the latent image on the surface of the electrostatic imaging member.

14. A colour printing system, comprising:

a plurality of printing systems as defined in claim 1, each to print with a different coloured ink;

a media handling mechanism to advance a media through each of the plurality of printing systems; and a controller to:

obtain image data representing different colour separations of an image to be printed; and control the media handling mechanism and plurality of printing systems such that each of the plurality of printing systems prints on the media a different colour separation of the image to be printed.

15. A printing system comprising:

a printhead receiver to receive a printhead, the printhead to eject printing fluid drops from an array of printhead nozzles to a first printing fluid receiving zone;

a rotatable electrostatic imaging member to store a latent image comprising charged and non-charged portions representing an image to be printed, wherein, as the charged portions of the rotatable electrostatic imaging member rotate proximate the array of printhead nozzles, ejected printing fluid drops are electrostatically deflected by the proximate charged portions of the electrostatic imaging member to a second printing fluid receiving zone.

16. The printing system of claim 15 further comprising:

an imaging module spaced apart from the printhead receiver, the imaging module to selectively dissipate electrical charges on the rotatable electrostatic imaging member as the rotatable electrostatic imaging member rotates to thereby form the charged and non-charged portions, the imaging module to selectively dissipate the electrical charges based on the image to be printed.

17. The printing system of claim 16, wherein the rotatable electrostatic imaging member is a photoconductor, and the imaging module comprises a light emitting diode.

18. The printing system of claim 15, wherein the rotatable electrostatic imaging member comprises a photoconductor drum.

19. The printing system of claim 15, wherein the rotatable electrostatic imaging member comprises a photoconductor belt.

* * * * *